United States Patent [19]

Gradeff et al.

[11] Patent Number: 4,743,473

[45] Date of Patent: May 10, 1988

[54] METHOD OF PRESERVING WOOD WITH LANTHANIDE DERIVATIVES

[75] Inventors: Peter S. Gradeff, Pottersville; John F. Davison, Edison, both of N.J.

[73] Assignee: Rhone-Poulenc Inc., Monmouth Junction, N.J.

[21] Appl. No.: 17,159

[22] Filed: Feb. 20, 1987

[51] Int. Cl.[4] ..... B05D 1/18; B05D 3/00

[52] U.S. Cl. ..... 427/297; 106/15.05; 252/397; 427/440; 428/541

[58] Field of Search ..... 427/297, 298, 440; 106/15.05; 252/397; 428/541

[56] References Cited

U.S. PATENT DOCUMENTS 4,287,239 9/1981 Hager ..... 427/440 X 4,303,705 12/1981 Kelso ..... 427/440 X 4,335,109 6/1982 Hill ..... 427/440 X 4,532,161 7/1985 Collins et al. ..... 427/440

*Primary Examiner*—Michael R. Lusignan

*Attorney, Agent, or Firm*—Morgan & Finnegan

[57] ABSTRACT

The invention is a method for pressure treatment of wood using compositions comprising aqueous solutions of one or more lanthanide derivatives. Wood is immersed in a pressure vessel containing a lanthanide derivative composition, and hydrostatic pressure is applied. The treatment is carried out at temperatures not exceeding about 95° C., and more preferably at between about 20° C. and about 30° C. Pressure should be greater than about atmospheric, and preferably about 10 psi to about 300 psi.

17 Claims, No Drawings

METHOD OF PRESERVING WOOD WITH LANTHANIDE DERIVATIVES

FIELD OF THE INVENTION

The invention relates to a method of preserving wood with lanthanide derivatives.

BACKGROUND OF THE INVENTION

Wood preservatives known in the art are either oil-based or water-based. Oil-based preservatives fall into two main classes, namely (i) coal tar creosote and solutions of cresote with coal tar or petroleum oils and (ii) solutions of preservative chemicals, such as pentachlorophenol dissolved in a suitable organic carrier.

One disadvantage of oil based preservatives is that they exude from the wood. Thereafter they may wash from the surface or evaporate. In order to compensate for the loss of the oil-based preservative, high initial retentions are required. In tropical and high rainfall areas, the use of oil-based preservatives has been found to be uneconomical. Another disadvantage of certain oil-based preservatives is that they are regarded as a skin irritants and can cause burns. Furthermore, oil-based preservatives such as creosote cannot be painted and do not have attractive appearances. These preservatives often have toxic side effects.

Water based preservatives are those containing chemical preservatives in the form of aqueous solutions. Such preservatives react within the wood to form compounds, the solubility of which may be increased by adjustment of pH. When chemical changes occur within the wood resulting in compounds with very low solubility, the compounds are designated as leach-resistant. Those which form soluble compounds are designated as leachable.

Leach-resistant water-based preservatives in commercial use include acid copper chromate solution (ACC), chromated copper arsenate solution (CCA) and ammoniacal copper arsenate solution (ACA). CCA solutions are commonly used. They form, in the wood, compounds which are toxic to both fungi and insects. Leachable water-based preservatives include chromated zinc chloride and fluoride-chromium-arsenate-phenol mixtures and boron compounds. The leachable water-based preservatives can only be used in treating timber to be used internally or where leaching conditions are not severe.

Use of water-based preservatives has many advantages: cleanliness, paintability of the treated wood, freedom from odor, and when correctly applied, longer protection of the wood.

A pressure method is commonly used to treat wood with waterbased preservatives. Essential features of the pressure method are that (1) the wood is surrounded by a preservative solution in a closed vessel; and (2) hydrostatic pressure is applied by mechanical means to force the solution into void spaces in the wood. It is conventional to evacuate the system to about 26" of mercury vacuum to remove air from cells within the wood. When a solution of CCA is used to impregnate wood, the CCA reacts inside the wood with reducing sugars found therein to form a mixture of insoluble salts.

U.S. Pat. No. 2,565,175 to Häger describes methods for making preservatives for wood and other organic materials. Preservatives according to the invention contain a five valent arsenic compound and six valent chromium compound of one or more metals. The arsenic compound can be arsenic acid (arsenic pentoxide) or an acid arsenate of one or more metals. Suitable metals according to Häger, are zinc, copper, aluminum, magnesium, cadmium, manganese, iron, mercury, chromium, and nickel.

U.S. Pat. No. 3,080,212 to Oberley et al. describes an improvement in a process for treating wood with a preservative solution in which chemical changes occur causing precipitation of difficulty soluble substances after introduction of the solution into the wood to be impregnated. CCA solutions are described as effective preservatives for prevention of decay and deterioration of wood. The improvement is described as treatment of wood with hot chromated copper arsenate solution stabilized by the addition of ozone.

U.S. Pat. No. 4,287,239 to Häger describes a method of preserving wood using specific types of preservatives in combination with specific methods and conditions of penetration and distribution of these preservatives within the wood. One specific type of preservative is CCA, to which ammonia is added to render the preservative solution alkaline. The ammonia addition prevents rapid fixation of the preservative in the wood. According to the method described by Häger, the preservative is introduced into the wood and the wood is kept in an undried solution for a period of time during which no fixation of the preservative occurs, and the preservative diffuses through the cell walls. Thereafter, the wood is dried.

U.S. Pat. No. 4,303,705 to Kelso, Jr. describes a process for the treatment of wood in which water-borne wood treatment materials, such as CCA solutions, are forced into the wood under pressure, and the water-borne wood treatment materials are held within the wood under pressure until they are deposited as by precipitation or chemical fixation.

U.S. Pat. No. 4,325,993 to Schroder describes a process for preserving wood against attack by living organisms, e.g., fungi and insects. The process may comprise one or two steps. In the two step process, there is a fungicidal step comprising introducing a copper solution into wood, and an insecticidal step comprising introducing a chromium and arsenic solution into wood.

One disadvantage of using CCA is that not all fixation of the preservatives takes place in the wood. Sludging may occur in the working solution due to pickup of wood or wood extractives, corrosion, or impurities in the chemicals used to make up the solution. Sludging causes a deposit of solids on the surface of the wood. These deposits contain varying percentages of arsenic and thus are a matter of environmental concern. Recent treatment standards (AWPA 1982) have recognized this (see Hartford, W., "The Practical Chemistry of CCA in Service", American Wood Preservers' Association Annual Meeting, April 28, 29 and 30, 1986, pp. 1–16).

Lanthanide derivatives are used in glass, ceramic, paint, plastics, and rubber manufacture. Compositions comprising cerium compounds are known to have bacteriocidal effects, e.g. compositions comprising cerium nitrate and silver sulfadiazine (Boeckx, et al., *Burns* vol. 11, no. 5 (1985) pp. 337–342; Monafo, *3rd International Congress on Pharmacological Treatment of Burns,* Milan, Italy, May 12–15, 1980, *Panmainerva Med.,* vol 25, no. 3 (1983) pp. 151–154; Bowser, et al., *J. Trauma.* vol. 21, no. 7 (1981) pp. 558–563; Monafo, et al., *Arch. Surg.* vol. 113, no. 4 (1978) pp. 397–401; Monafo, et al. *Surgery* (St. Louis) vol. 80, no. 4 (1976) pp. 465–473), and compositions containing electrically activated silver and cerium stearate (Colmano, et al., *23rd Annual Meeting of the Biophysical Society (New York), Atlanta Ga.*, Feb. 26–28, 1979, *Biophys. J.* vol. 25, no. 2, part 2 (1979) p. 217A). Cerium derivatives are also used as additives in plastics for food packaging.

It is an object of the present invention to provide a new safe method for treating wood with compositions comprising water soluble lanthanide derivatives. It is a further object of the invention to achieve permanent bonding of lanthanide ions to wood fibers. It is a further object of the present invention to promote flame retardation and to inhibit wood decay resulting from exposure to bacteria, insects, or atmospheric conditions. These and other objects are met by the present invention and are further described in the specification.

SUMMARY OF THE INVENTION

This invention is directed to a method for pressure treatment of wood using compositions comprising aqueous solutions of one or more lanthanide derivatives. Wood is immersed in a pressure vessel containing a lanthanide derivative composition, and hydrostatic pressure is applied. The treatment is carried out at temperatures not exceeding about 95° C., and preferably at about ambient temperature, i.e. 20° C.–30° C., and at hydrostatic pressures greater than atmospheric, and preferably between about 10 psi and about 300 psi.

DETAILED DESCRIPTION OF THE INVENTION

According to the method of this invention, wood is impregnated under pressure with an aqueous solution containing one or more lanthanide derivatives.

Suitable lanthanide derivatives include the lanthanides, lanthanum, cerium, praseodymium, neodymium, samarium, europium, gadolinium, terbium, dysprosium, holmium, erbium, thulium, ytterbium, lutetium, or mixtures thereof. Preferred lanthanides are cerium, lanthanum, praseodymium, and neodymium. Cerium can be trivalent or tetravalent.

The lanthanide cation can be bonded to an inorganic anion such as nitrate, chloride, sulfate, perchlorate, phosphate, or phosphonate. The lanthanide cation can also be bonded to an organic ligand such as lower alkyl carboxylate, e.g. acetate, propionate, acrylate, methacrylate, gluconate, alkyl sulfonate or alkyl phosphonate. Derivatives having both inorganic and organic ligands are also suitable for the present invention.

The lanthanide derivatives may be used alone or in admixture with other wood treatment agents such as flame retardants, coloring agents, anti-checking agents, anti-static agents, dimensional stabilizers, film-formers, wood softening agents, and other biocides or fungicides.

The lanthanide derivatives must be soluble in water, preferably in an amount at least about 0.1% by weight. Use of concentrations less than 0.1% by weight is not economical. Concentrations about 0.1% to about 10% are preferred, although higher concentrations can be used. Concentrations about 0.5% to about 2.5% are more preferred.

It is believed that the reaction that takes place during treatment of wood according to the method of the invention is crosslinking of cellulose fibers with the lanthanide ion. Crosslinking takes place under approximately neutral or lower range pH (less than about 7.0) and under hydrostatic pressure, the wood preferably being completely immersed in the treating solution. Pressure treatment is required for the lanthanide cation to penetrate the cellulosic fibers, and to react with hydroxy or other active sites of the wood. Linkage could involve one or all of the valencies of the lanthanide.

The time necessary to achieve a sufficient amount of permanent bonding of the lanthanide to the wood depends on several factors, e.g. temperature, pressure, wood moisture, and the nature of the wood itself. Preferably, contact time is from about 0.5 to about 10 hours. Of course, longer periods of time may be used. Contact time may be decreased with increased pressure. Preferred contact time is from about 3 to about 6 hours. Evidence shows that while most of the bonding occurs during immersion of wood in the lanthanide solution, the bonding reaction may continue for several days after the treatment.

Pressure must be above atmospheric. At atmospheric pressure, permanent bonding does not occur to a significant extent. While some inpregnation does occur, the deposited derivative may be almost entirely leached from the wood. Preferably, pressure is between about 10 psi and about 300 psi, more preferably about 50 psi to about 280 psi. The pressure is maintained using one or more inert gases, e.g. nitrogen gas.

Treatment temperature should not exceed about 95° C. Preferably, temperatures are about ambient, i.e. 20° C.–30° C. For some treatments, temperature of about 40°–60° C. is preferred to assist penetration and bonding of lanthanide to the wood fibers.

After treatment, the aqueous solution is drained off. The amount of lanthanide derivatives can be adjusted and the resulting solution used to treat another load of wood. Treated wood is simply left to dry. The treated wood is resistant to decay caused by exposure to bacteria, insects, and atmospheric conditions. Furthermore, the treatment promotes flame retardation. One of the great advantages to using lanthanides is their relative safety which is important during processing, disposing, or subsequent leaching or sludging if they are to occur.

The following examples describes particular embodiments of the invention. The examples should not be interpreted as limiting the scope of the invention.

EXAMPLES

A series of pressure treatment tests was run whereby southern yellow pine was treated with lanthanide derivatives using a procedure known in the art for treating southern yellow pine with CCA. Small pieces of untreated kiln dried pine were placed in a pressure apparatus. Aqueous compositions containing lanthanide derivatives were added to the apparatus in an amount sufficient to immerse the wood. Pressure was maintained using nitrogen gas. In order to determine the amount of metal permanently bonded to the wood, the sample of treated wood was water washed for 12 hours in running water. The washed wood was then dried, and the percentage of "ash" measured after burning and calcining the residue of the sample. The percentage "ash" of wood prior to treatment was subtracted from the percentage "ash" of treated wood to measure the amount of permanently bonded metal.

Results are shown in Table I. All treatments, unless otherwise indicated, were at room temperature. Untreated pine used for tests 1–18 contained about 0.08% ash. Untreated pine used for all other tests contained about 0.12% ash. A commercial sample of southern yellow pine treated with CCA was measured for percentage "ash" as a control.

TABLE I

| Test # | Preservative compound of the test composition | Treatment | % Ash | Days prior to washing |
|---|---|---|---|---|
| Control | CCA | Commercial | 0.94 | Commercial |
| | CCA | sample | 1.21 | sample |
| 1 | $Ce(NO_3)_3$ (1%, pH 5.1) | 3 hrs, 240 psi | 0.52 | —* |
| 2 | $Ce(NO_3)_3$ (1%, pH 5.1) | 5½ hrs, 230 psi | 0.71 | — |
| 3 | $Ce(NO_3)_3$ (1%, pH 5.1) | 5½ hrs, 230 psi | 1.0 | 14 |
| 4 | $Ce(NO_3)_3$ (1%, pH 5.1) | 3 hrs, 180 psi, 50° C. | 0.90 | 7 |
| 5 | $Ce(NO_3)_3$ (1%, pH 5.1) | 6 days, atm. | 0.18 | — |
| 6 | $Ce(NO_3)_4$ (1%, pH 4.5) | 5½ hrs., 230 psi | 0.57 | — |
| 7 | $Ce(NO_3)_4$ (1%, pH 4.5) | 5½ hrs., 230 psi | 0.58 | 7 |
| 8 | $Ce(NO_3)_4$ (1%, pH 4.5) | 5½ hrs., 230 psi | 0.66 | — |
| 9 | $Ce(NO_3)_4$ (2%, pH 4.7) | 3 hrs., 230 psi | 0.60 | — |
| 10 | $Ce(NO_3)_4.2NH_4$ (1%, pH 6.0) | 5½ hrs., 230 psi | 1.35 | — |
| 11 | $Ce(NO_3)_4.2NH_4$ (1%, pH 6.0) | 5½ hrs., 230 psi | 1.15 | 4 |
| 12 | $Ce(NO_3)_4.2NH_4$ (1%, pH 6.0) | 5½ hrs., 230 psi | 0.94 | — |
| 13 | $Ce(NO_3)_4.2NH_4$ (1%, pH 6.0) | 6 days, atm. | 0.185 | — |
| 14 | Cerous methacrylate (1%) | 5½ hrs., 230 psi | 0.55 | — |
| 15 | Cerous methacrylate (1%) | 5½ hrs, 240 | 0.61 | 20 |
| 16 | Cerous methacrylate (1%) | 6 days, atm. | 0.28 | — |
| 17 | Cerous lactate (1%, pH 6.0) | 5½ hrs., 260 psi | 0.73 | — |
| 18 | Cerous lactate (1%, pH 6.0) | 5½ hrs., 260 psi | 1.16 | 8 |
| 19 | Cerous lactate (1%, pH 6.0) | 6 days, atm. | 0.15 | — |
| 20 | $La(NO_3)_3$ (1%, pH 3.3) | 5½ hrs, 220 psi | 0.21 | — |
| 21 | $La(NO_3)_3$ (1%, pH 3.3) | 5½ hrs, 220 psi | 0.51 | 6 |
| 22 | $La(NO_3)_3$ (1%, pH 3.3) | 6 days, atm. | 0.32 | — |
| 23 | Lanthanide mix $(NO_3)_3$** (1%, pH 3.0) | 5½ hrs., 220 psi | 0.51 | — |
| 24 | Lanthanide mix $(NO_3)_3$** (1%, pH 3.0) | 5½ hrs., 220 psi | 1.06 | 6 |
| 25 | Lanthanide mix $(NO_3)_3$** (1%, pH 3.0) | 6 days, atm. | 0.21 | — |
| 26 | Cerous acetate (1%, pH 4.3) | 5½ hrs, 220 psi | 0.75 | — |
| 27 | Cerous acetate (1%, pH 4.3) | 5½ hrs, 220 psi | 1.50 | 5 |
| 28 | Cerous acetate (1%, pH 4.3) | 6 days, atm. | 0.044 | — |
| 29 | Cerous propionate (1% aq. pH 7.3) | 5½ hrs, 220 psi | 0.71 | — |
| 30 | Cerous propionate (1% aq. pH 7.3) | 5½ hrs, 220 psi | 1.53 | 5 |
| 31 | $Ce(NO_3)_4$ $2NH_4$ (2%, pH 5.0) | 10 hrs, 50 psi | 0.49 | — |
| 32 | $Ce(NO_3)_4$ $2NH_4$ (0.5%, pH 5.0) | 1 hr, 60° C. 220 psi | 0.70 | — |
| 33 | $Ce(NO_3)_4$ $2NH_4$ (15.0%, pH 4.2) | 5½ hrs, 220 psi | 1.30 | 7 |
| 34 | $Ce(NO_3)_4$ $2NH_4$ (15.0%, pH 4.2) | 5½ hrs, 10 psi | 0.50 | 10 |
| 35 | Cerous Toluene sulfonate (1.0%, pH 5.0) | 4 hrs, 250 psi | 0.95 | — |
| 36 | $Ce(SO_4)_2$ (1.0%, pH 20) | 5 hrs, 200 psi | 1.0 | 2 |

*"—" indicates washing was done immediately after wood was removed from the lanthanide composition.
**Mixture of $Ce(NO_3)_3$, $La(NO_3)_3$, $Pr(NO_3)_3$ and $Nd(NO_3)_3$.

Test results show that more lanthanide derivative becomes permanently bonded to wood when pressure is applied than is permanently bonded under atmospheric pressure. Furthermore, during aging after treatment, percentage "ash" increases. This indicates that the bonding process continues over several days. Table II illustrates the advantage of aging.

TABLE II

| Compound | % ash (days prior to washing) | % ash (immediate wash) |
|---|---|---|
| Cerous acetate | 1.5 (5) | 0.75 |
| Cerous propionate | 1.5 (5) | 0.71 |
| Cerous lactate | 1.16 (8) | 0.73 |
| $Ce(NO_3)_6.2NH_4$ | 1.15 (4) | 1.35 |
| Lanthanide mix $(NO_3)_3$ | 1.06 (6) | 0.51 |
| Cerous $(NO_3)_3$ | 1.00 (14) | 0.71 |
| Cerous methacrylate | 0.61 (20) | 0.55 |
| $La(NO_3)_3$ | 0.51 (6) | 0.21 |

What is claimed is:

1. A method of preserving wood comprising the steps of (a) immersing wood into a composition comprising an aqueous solution of one or more lanthanide derivatives; and (b) maintaining elevated pressure for a period of time sufficient to permanently bond the lanthanide to the wood.

2. A method according to claim 1, wherein the lanthanide is cerium.

3. A method according to claim 1, wherein the lanthanide is lanthanum.

4. A method according to claim 1, wherein the composition comprises one or more cerium compounds selected from the group consisting of $Ce(NO_3)_3$, $Ce(NO_3)_4$, $CeCl_3$, $Ce_2(SO_4)_3$, $Ce(SO_4)_2$, $Ce(NO_3)_4.2NH_4$, Cerous acetate, Cerous methacrylate, Cerous lactate, Cerous propionate, and Cerous toluene sulfonate.

5. A method according to claim 1, wherein the composition comprises $La(NO_3)_3$.

6. A method according to claim 1, wherein the composition comprises a mixture of lanthanide derivatives.

7. A method according to claim 1, wherein the wood is contacted with the solution under pressure greater than about atmospheric pressure.

8. A method according to claim 7, wherein the pressure is between about 10 psi and about 300 psi.

9. A method according to claim 8, wherein the pressure is between about 50 psi and about 280 psi.

10. A method according to claim 1, wherein the period of time is between about 0.5 and about 10 hours.

11. A method according to claim 10, wherein the period of time is between about 3 and about 6 hours.

12. A method according to claim 1, wherein immersion occurs at a temperature less than about 95° C.

13. A method according to claim 12, wherein immersion occurs at about ambient temperature.

14. A method according to claim 12, wherein immersion occurs between about 20° C. to about 30° C.

15. A method according to claim 1, wherein the aqueous solution comprises about 0.1% to about 10% by weight of one or more lanthanide derivatives.

16. A method according to claim 15, wherein the aqueous solution comprises about 0.5% to about 2.5% by weight of one or more lanthanide derivatives.

17. A method according to claim 1, wherein the aqueous solution is at a pH less than about 7.0.

* * * * *